United States Patent [19]

Yoneyama et al.

[11] 4,198,478

[45] Apr. 15, 1980

[54] METHOD FOR DISPERSING A PHOTOGRAPHIC ADDITIVE

[75] Inventors: Masakazu Yoneyama; Jiro Yamaguchi; Takeshi Mikami, all of Minimi-ashigara, Japan

[73] Assignee: Fuji Photo Film Co., Ltd., Minami-ashigara, Japan

[21] Appl. No.: 904,664

[22] Filed: May 10, 1978

[30] Foreign Application Priority Data

May 10, 1977 [JP] Japan ..... 52-53548

[51] Int. Cl.[2] ..... G03C 1/40; G03C 1/84; G03C 1/10; G03C 1/48

[52] U.S. Cl. ..... 430/449; 430/222; 430/223; 430/512; 430/546; 430/559; 430/566; 430/569; 252/353; 252/355

[58] Field of Search ..... 96/114.5, 114, 97, 95, 96/99, 84 UV, 77, 119 R, 100; 252/353, 355

[56] References Cited

U.S. PATENT DOCUMENTS

| | | | |
|---|---|---|---|
| 3,415,649 | 12/1968 | Nishio et al. | 96/114.5 |
| 3,860,425 | 1/1975 | Ono et al. | 96/114.5 |

*Primary Examiner*—Richard L. Schilling
*Attorney, Agent, or Firm*—Sughrue, Rothwell, Mion, Zinn and Macpeak

[57] ABSTRACT

A method for dispersing an oil-soluble photographic additive which comprises dissolving the additive in an organic solvent and dispersing the resulting solution of the photographic additive in water or a hydrophilic colloid composition in the presence of a surface active polymer comprising (a) a homopolymer of units represented by the formula (I):

(I)

wherein R is an aliphatic hydrocarbon group having 4 to 22 carbon atoms; $m_1$ and $m_2$ each is 0 or 1; B is —O— or —NH—; A is a divalent aliphatic group having 1 to 50 carbon atoms; and M is a hydrogen atom or a cation group capable of forming a salt with a sulfonic acid group, or (b) a copolymer containing at least 5 mol% of units represented by the formula (I) above and the balance of divalent units copolymerizable therewith and comprising at least one of a benzene ring having a methylene group attached thereto and a naphthalene ring having a methylene group attached thereto.

9 Claims, No Drawings

METHOD FOR DISPERSING A PHOTOGRAPHIC ADDITIVE

BACKGROUND OF THE INVENTION

1. Field of the Invention

The present invention is directed to a method for incorporating an oil-soluble photographic additive into a hydrophilic colloid layer and, more particularly, to a method for dispersing an oil-soluble photographic additive into a hydrophilic colloid composition or into water.

2. Description of the Prior Art

In the preparation of photographic silver halide emulsion layers and hydrophilic colloid layers other than the photographic silver halide emulsion layers, either water-insoluble or slightly water-soluble materials (hereinafter referred to as "oil-soluble photographic additives") often must be incorporated therein. These additives that are insoluble in a hydrophilic colloid medium should be uniformly dispersed in a very finely divided form.

Color photographic light-sensitive materials using a variety of light-sensitive components are known, but, in general, silver halide is employed as a light-sensitive component. Such a silver halide color photographic light-sensitive material comprises a support having thereon, in sequence, a red-sensitive silver halide emulsion, a green-sensitive silver halide emulsion and blue-sensitive silver halide emulsion, in various orders. For example, a mixed grain method, a multilayer color light-sensitive material, a color diffusion transfer method, a silver dye bleach color photographic method, and many other methods are known.

In recent years, rendering a photographic additive which is to be employed in a silver halide color photographic light-sensitive material oil-soluble and dissolving such in a substantially water-insoluble high-boiling point solvent (for instance, a high-boiling point organic solvent) and then dispersing the resulting solution in a hydrophilic colloid aqueous solution generally using an anionic surface active agent as an emulsifying agent, for the purpose of various improvements in color photographic materials, has been an approach widely employed in the photograhic art.

Examples of oil-soluble photographic additives include an oil-soluble coupler, an ultraviolet absorbant, an anti-color fading agent, an antioxidant, a dye releasing agent for the color diffusion transfer method, a dye developer, and many other additives.

Numerous methods for emulsion dispersing such oil-soluble photographic additives, for example, as described in U.S. Pat. Nos. 2,739,888, 3,352,681, etc., relating to ultraviolet light absorbants; U.S. Pat. Nos. 2,360,290, 2,728,659, 3,700,453, etc., regarding diffusion resistant alkyl hydroquinones which are employed for preventing color fog, color stain, color mixing, etc., are known. In particular, methods for emulsion dispersing oil-soluble photographic additives in which anionic surface active agents are employed as emulsifying agents are known. For example, a method using Gardinol WA (trade name for a sulfonated coconut fatty alcohol, made by E. I. Du Pont de Nemours Co., Inc.) and triisopropyl naphthalenesulfonic acid salt as described in U.S. Pat. No. 2,332,027; a method using as an emulsifying agent a water-soluble coupler having a sulfo group or carboxyl group and a long chain aliphatic group in combination as described in Japanese Pat. No. 428,191; and a method using an anionic surface active agent having a sulfo group in combination with an anhydrohexyl ester type nonionic surface active agent as described in U.S. Pat. No. 3,676,141 are known. All of these emulsion dispersing methods provide coarse dispersion particles (e.g., a particle size larger than about 2μ) and do not result in finely divided dispersion particles (e.g., smaller than about 0.5μ), which have been required in recent photographic light-sensitive materials, being produced. In particular, the thickness of photographic elements to be coated onto a support in design of color photographic light-sensitive materials have increased and, therefore, if a dispersion to be incorporated therein is composed of coarse particles, light scattering which adversely affects the photographic properties occurs, when light passes through a photographic element, and this results in turbidity. In addition, light scattering also deteriorates the image quality such as image sharpness, graininess or the like. On the other hand, particularly, if microparticles of a coupler dispersion are formed, the surface area per unit weight of the particles becomes large, color formation speed as well as efficiency are increased, the covering power of the dye images formed is also increased, and the image density increases. However, generally, a large amount of an emulsifier must be used in order to markedly decrease the particles of a dispersion. If a large amount of an emulsifier is employed, coating difficulties due to foaming of an emulsion, for example, occurrence of pin holes, uneven thickness in the coated layers, etc., tend to occur. In addition, a deterioration in the film quality of a photographic element in which light-sensitive materials are coated (for example, the tackiness and adhesivity of the coated layers increase especially at high temperature and high humidity so that undesired adhesion between photographic light-sensitive materials or between the material and a camera, etc., tends to occur) results. Furthermore, a prevention of the antistatic effects due to an antistatic agent which may be employed in combination is also encountered. If the particle size of dispersed particles of an emulsion dispersion is further decreased, aggregation of particles, a destruction of the dispersion, etc., tend to occur with the passage of time, in general.

With the use of the above-described conventional surface active agents, formation of a finer dispersion cannot be achieved without the defects accompanying such finer particles being encountered.

SUMMARY OF THE INVENTION

A first object of the present invention is to provide a method for finely dispersing oil-soluble photographic additives (for example, oil-soluble couplers, oil-soluble ultraviolet light absorbants, dye releasing agents for the color diffusion transfer method, etc.) in water or in an aqueous hydrophilic colloid solution.

A second object of the present invention is to provide a silver halide color photographic light-sensitive material having high color forming capability which can be easily produced and can be stored in a stable condition for a long period of time without aggregation of particles and crystallization occurring.

A third object of the present invention is to provide a photographic light-sensitive material in which the adverse effects described above do not occur and which has an improved surface layer quality.

A fourth object of the present invention is to provide a color photographic light-sensitive material which does not have the defects described above.

The various objects of the present invention are achieved by a method for dispersing at least one oil-soluble photographic additive in water or in a hydrophilic colloid composition comprising dissolving the photographic additive in at least one organic solvent, dispersing the resulting organic solvent solution of the photographic additive into water or into a hydrophilic colloid composition in the presence of a surface active polymer comprising (a) a homopolymer of units represented by the following general formula (I):

(I)

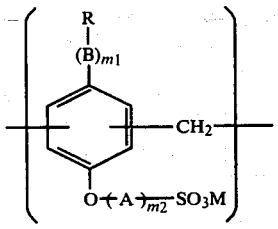

wherein R represents an aliphatic hydrocarbon group having 4 to 22 carbon atoms; $m_1$ and $m_2$ each represents 0 or 1; B represents —O— or —NH—; A represents a divalent aliphatic group having 1 to 50 carbon atoms; and M represents a hydrogen atom or a cation capable of forming a salt with a sulfonic acid group, or (b) a copolymer containing at least 5 mol% of units represented by the formula (I) above and the balance of divalent units copolymerizable therewith and comprising at least one of a benzene ring having a methylene group attached thereto and a naphthalene ring having a methylene group attached thereto.

DETAILED DESCRIPTION OF THE INVENTION

R in the general formula (I) described above is an aliphatic hydrocarbon group having 4 to 22 carbon atoms which can be a straight chain or branched chain and further can contain one or more unsaturated bonds. A preferred number of carbon atoms for R is about 6 to about 18. Specific examples of R include an alkyl group such as a butyl group, an octyl group, a nonyl group, a dodecyl group, an octadecyl group, etc., and an alkenyl group such as a cis-9-octadecenyl group, etc.

A represents a divalent aliphatic group having 1 to 50 carbon atoms and preferably is a divalent group such as an alkylene group, an alkyleneoxy group, a polyalkyleneoxy group, an alkyleneoxyalkylene group, etc. Specific examples of divalent aliphatic groups for A include an ethylene group, a trimethylene group, an octamethylene group, an ethyleneoxy group, a polyethyleneoxy group, a polypropyleneoxy group, an ethyleneoxytrimethylene group, etc.

Typical examples of M include a hydrogen ion, a sodium ion, a potassium ion, a lithium ion, a calcium ion, a barium ion, an ammonium ion, an alkylammonium ion having 1 to 4 carbon atoms, etc.

The surface active polymer described above can be a copolymer or a homopolymer. Where the surface active polymer is a copolymer, it is preferred for the unit represented by the general formula (I) to be present in the copolymer in an amount of about 5 to about 95 mol%, more preferably about 10 to 95 mol%. One or more different units can be copolymerized with the unit represented by the formula (I). Suitable units which can be copolymerized include a divalent unit comprising a benzene ring having a methylene group attached thereto and a naphthalene ring having a methylene group attached thereto. The benzene ring can be substituted with one or more substituents, for example, an alkyl group (preferably an alkyl group having 2 to 22 carbon atoms, e.g., a butyl group, an octyl group, a nonyl group, a dodecyl group, an octadecyl group, etc.), a halogen atom (e.g., a chlorine atom, a bromine atom, an iodine atom, etc.), a hydroxy group, an alkoxy group (preferably in which the alkyl moiety has 2 to 22 carbon atoms, e.g., an octyloxy group, a hexyloxy group, a dodecyloxy group, a β-hydroxyethoxy group, etc.), a haloalkoxy group (preferably in which the alkyl moiety has 2 to 22 carbon atoms, e.g., a β-chloroethoxy group, a β-bromoethoxy group, etc.). It is preferred for at least one of the substituents to be substituted.

Specific examples of units which can be copolymerized with the unit represented by the formula (I) include:

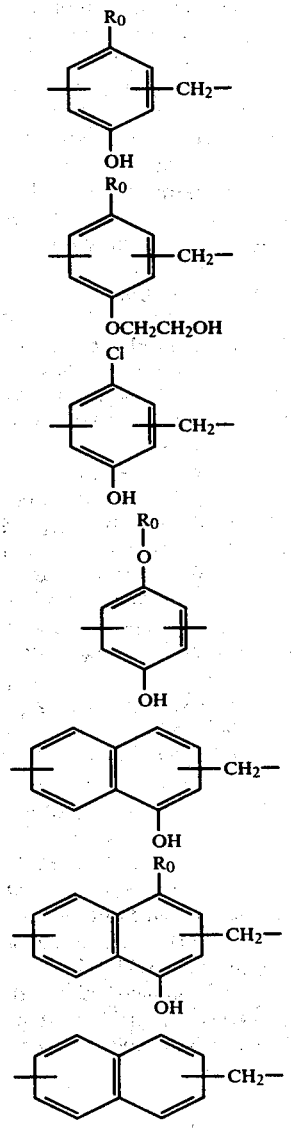

wherein $R_0$ represents an aliphatic hydrocarbon group having 2 to 22 carbon atoms.

The molecular weight of the surface active polymer employed in accordance with the present invention is not particularly limitative, but a preferred molecular weight is about 600 to about 10,000, more preferably 900 to 5,000.

Specific examples of representative surface active polymers which can be employed in accordance with the present invention are shown below. The surface active polymer compounds contain the structural units indicated below in the ratios indicated below, respectively.

(1)

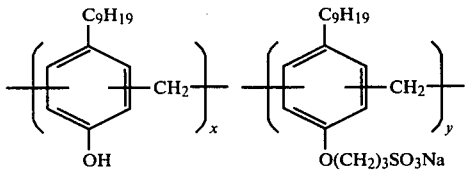

x:y y = 5:5 x + y ≅ 6

(2)

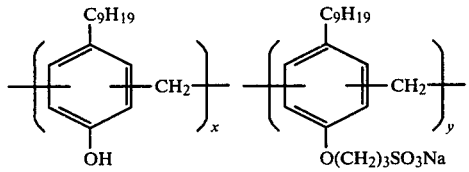

x:y = 2:8 x + y ≅ 6

(3)

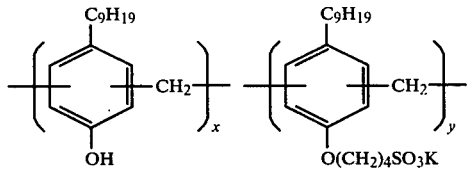

x:y = 1:9 x + y ≅ 6

(4)

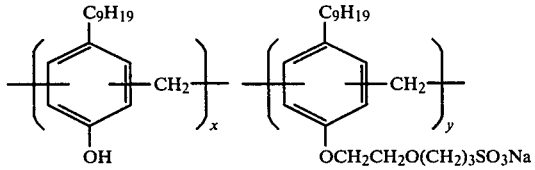

x:y = 5:5 x + y ≅ 6

(5)

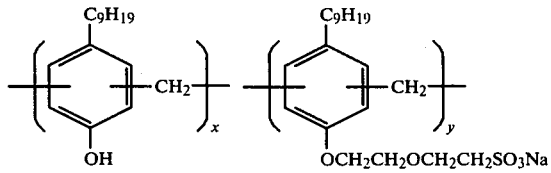

x:y = 2:8 x + y ≅ 10

(6)

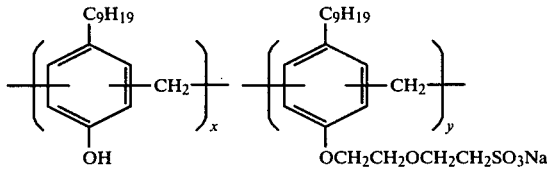

x:y = 2:8 x + y ≅ 25

(7)

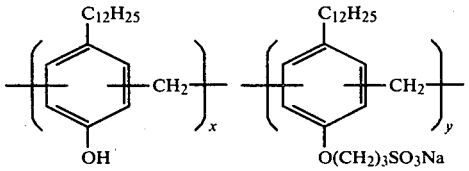

x:y = 1:9 x + y ≅ 10

-continued

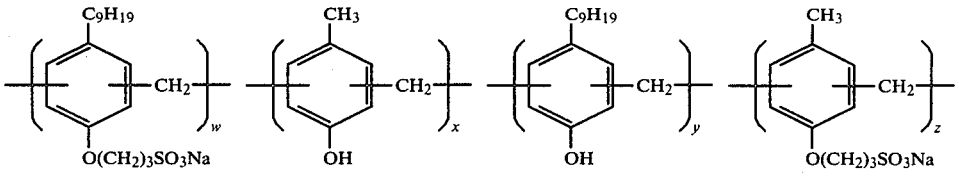

(8)

(w + z):(x + y) = 8:2
w + x + y + z ≅ 8

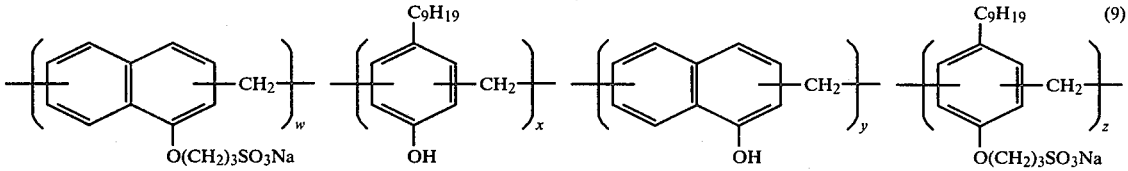

(9)

(w + z):(x + y) = 8:2
w + x + y + z ≅ 8

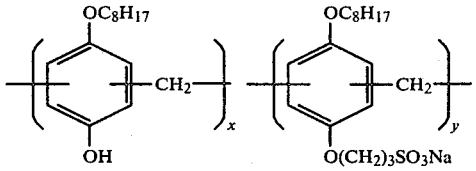

(10)

x:y = 4:6 x + y ≅ 8

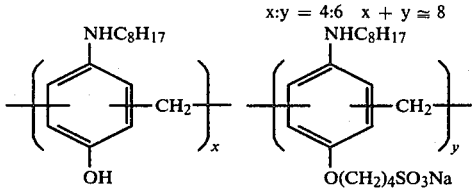

(11)

x:y = 5:5 x + y ≅ 4

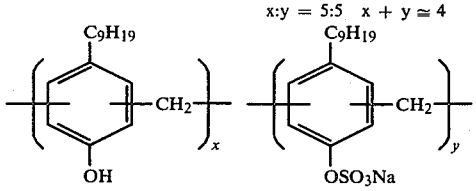

(12)

x:y = 6:4 x + y ≅ 6

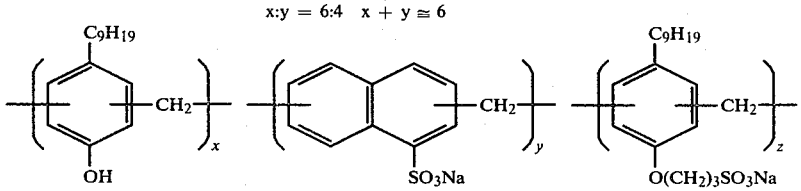

(13)

x:y:z = 4:3:3
x + y + z ≅ 6

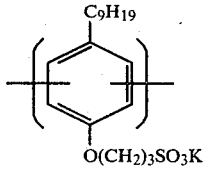

(14)

degree of polymerization : about 6

In the above formulas, the subscripts w, x, y and z represent the molar fraction of the unit of which they are subscripts in the polymer and the sum thereof given about indicates the degree of polymerization.

The surface active polymers containing the unit of the formula (I) employed in the present invention (hereinafter "surface active polymer" for brevity) can be synthesized using conventional methods. For example, formaldehyde polycondensates of alkylphenols can easily be synthesized using the method described in Kogyo Kagaku Zasshi (J. of Industrial Chemistry), Vol. 66, page 391 (1963), Yukagaku (Oil Chemistry), Vol. 12, page 625 (1963).

*Kogyo Kagaku Zasshi* (*J. of Industrial Chemistry*), Vol. 66, page 391 (1963) discloses the synthesis of alkylphenol formaldehyde resins.

The results of the elemental analysis of the nonyl phenol (a product of Sanyo Ushi K.K. was used without any modification) employed are shown in Table 1.

Table 1

| Elemental analysis of nonyl phenol | | |
|---|---|---|
| | Found | Calculated |
| C content (%) | 81.91 | 81.76 |
| H content (%) | 10.85 | 10.98 |

It was found to be substantially pure nonylphenol. The o- and p-nonyl phenol content was estimated from the IR absorption spectrum in a 10% solution of carbon disulfide (Ishii et al, Kogyo Kagaku Zasshi (J. of Industrial Chemistry), Vol. 61, page 180 (1958); Tanaka, Bunseki Kagaku (Analytical Chemistry), Vol. 6, page 168 (1957).

The o-nonyl phenol had a specific absorption band at 748 $cm^{-1}$, and p-nonyl phenol, at 824 $cm^{-1}$. From the relative absorption of these bands it was assumed that the nonyl phenol used in the experiment contained 70–80% of p-nonyl phenol and 20–30% of o-nonyl phenol. A commercial synthesized product (product of Konan Kako K.K.) was used as p-cresol having a melting point of 34.8° C. (before correction, reported value 34.6° C., see J. Kendall et al, *J. Am. Chem. Soc.*, Vol. 43 page 1847 (1921), and a gas chromatograph on Apiezon greast showed a purity of 99% or higher.

Commercial products were also employed as paraformaldehyde and p-toluenesulfonic acid.

To outline the synthesis method used, a mixture of nonyl phenol and formaldehyde at a molar ratio of 1:1 or a mixture of nonyl phenol, p-cresol and formaldehyde at a molar ratio of 1:2:3 was reacted in the presence of benzene or toluene as a solvent and p-toluenesulfonic acid as a catalyst. Water was removed from the reaction system as an azeotropic mixture with the solvent as the reaction continued. In preparing the nonyl phenol/formaldehyde resin, the molecular weight of the resin was varied by adjusting the reaction conditions and by fractionating the reaction product.

2.1.1 Resin A

A mixture comprising 110 g (0.5 mol) of nonyl phenol, 7.5 g (0.25 mol) of paraformaldehyde, 1.0 g of p-toluenesulfonic acid and 150 ml of benzene was heated, and the water by-produced was removed from the reaction system. After forty-five minutes (the resin recovered in this stage had an average molecular weight which approximated that of a dimer; molecular weight was measured by a freezing point depression method using benezene as a solvent (hereinafter the same)), an additional 7.5 g of paraformaldehyde was added to the reaction system followed by heating under reflux for 2 hours. A volume of 8.9 ml of water (calculated value; 9.0 ml) was removed in the course of the reaction. The reaction mixture was thoroughly washed with water to remove the catalyst, then dried with anhydrous sodium sulfate, filtered, dissolved in benzene to make 500 ml, cooled to about 5° C., and slowly mixed with 500 ml of a 90% aqueous methanol solution at about 5° C. under stirring. The liquid resing component in the lower level separated and was melted under heating on a water bath, followed by gradual cooling to room temperature. The lower layer was recovered, dried and filtered. The solvent was evaporated on a water bath, and the residue was thoroughly dried in vacuum at 65° C. to yield 40 g of a pale yellow solid product having a molecular weight of 1555.

2.1.2 Resin B

A mixture comprising 110 g (0.5 mol) of nonyl phenol, 15 g (0.5 mol) of paraformaldehyde, 1.0 g of p-tolunesulfonic acid and 150 ml of toluene was heated under reflux for 2.5 hours in the same manner as in the preparation of Resin A. A volume of 9.0 ml of water was removed. The reaction mixture was water-washed, dried, filtered, dissolved in toluene to make 500 ml, cooled to about 5° C., slowly mixed with 180 ml of methanol at about 5° C. under stirring, the liquid resin component in the lower layer being melted under heating on a water bath, followed by gradual cooling to room temperature. The lower layer was separated and discarded. In a like manner, an additional 200 ml of methanol was added followed by heating and cooling. Upon cooling it separated into two layers, the lower layer of which was treated in the same way as the preparation of Resin A to yield 33 g of a pale yellow solid product which had a molecular weight of 2735.

2.1.3 Resin C

A mixture comprising 220 g (1 mol) of nonyl phenol, 30 g (1 mol) of paraformaldehyde, 2.0 g of p-toluenesulfonic acid and 300 ml of toluene was reacted for 3 hours in the same manner as in the preparation of Resin A. A volume of 18.1 ml of water was removed. Then, the toluene was distilled off at a reduced pressure of about 500 mmHg and the contents were held at a temperature of about 160°;0 C. for 2 hours under the same reduced pressure. The contents was further held under vacuum of 2 mmHg at 210°–220° C. for 5 hours, and then at 230° C. for 2 hours. The reaction product was dissolved in 700 ml of benzene. The sparingly soluble matter was filtered, the filtrate was washed with water, dried, dissolved in benzene to make 1-liter, and cooled to about 5° C., followed by gradual addition of 1.2 l of methanol at about 5° C. under stirring. The liquid resin component in a lower layer was melted by heating on a water bath, followed by gradual cooling to room temperature. The resulting resin component in a lower layer was melted by heating on a water bath, followed by gradual cooling to room temperature. The resulting resin component was treated in the same manner as Resin A to yield 26 g of a product which was designated Resin C-I.

An additional 500 ml of methanol was added in the same manner as above and the resulting resin component produced was discarded. An additional amount (600 ml) of methanol was added in the same manner as above and the resin component obtained was dried to yield 35 g of a product having a molecular weight of 1355 and designated C-III. Freezing point depression method was not applicable to determination of the molecular weight of Resin C-I, but Resin C-I was assumed to have a significantly high molecular weight because an overall Resin C prepared separately from the initial benzene solution had a molecular weight of 4560. Both Resins C-I and C-III were gray with a tinge of green.

2.1.4 Cres Resin

A mixture comprising 44 g (0.2 mol) of nonyl phenol, 43.2 g (0.4 mol) of p-cresol, 18 g (0.6 mol) of paraformaldehyde, 1.0 g of p-toluenesulfonic acid and 150 ml of toluene was subjected to reaction for 2.5 hours under heating in the same manner as in the preparation of Resin A. A volume of 10.6 ml (calculated volume: 10.8 ml) of water was separated. The reaction mixture was washed with water, dried, filtered, dissolved in toluene to make 500 ml, cooled to about 5° C., and 500 ml of methanol was added at about 5° C. under stirring. The resin component was melted by heating on a water bath, and cooled gradually to room temperature. The liquid resin component in the lower layer was separated and treated by the same method as Resin A to yield 52 g of pale yellow solid product having a molecular weight of 1355.

*Yukagaki* (*Oil Chemistry*), Vol. 12, page 625 (1963) also discloses the synthesis of alkylphenol formaldehydes. Specifically, alkylphenol formaldehyde resins are generally synthesized by the reaction of alkyl phenol and formalin in a heterogeneous system or by removing water from the reaction system using toluene as a solvent. Experimentation showed that a series of condensation products of a desired degree of condensation, whose molecular weight ranges from a low molecular weight such as a dimer to a high molecular weight can advantageously be prepared by reaction in a homogeneous system using n-butanol as a solvent and wherein viscosity of the reaction mixture can be used as a guide for condensation degree. Based on this finding, a nonyl phenol formaldehyde resin (hereinafter referred to as NPF-resin) was synthesized under the following conditions and prepared resins of various molecular weights.

A 400 ml four-necked flask with a reflux condenser was charged with 111 g of nonyl phenol, 16.5 g of paraformaldehyde, 5 ml of 12 N hydrochloric acid, and 100 ml of n-butanol as a solvent, and heated in an oil bath at a predetermined temperature for reaction. After the end of the reaction, 80 ml of toluene and 60 ml of water were added to the contents which were then transferred into a separating funnel, where the toluene phase was water washed several times to remove hydrochloric acid. After dehydration with anhydrous sodium sulfate, the solvent was removed in a nitrogen stream, followed by removal of the unreacted nonyl phenol at a reduced pressure of 3 to 4 mmHg and 140° to 145° C. for 30 minutes.

Table 2 shows the reaction conditions used, the hydroxyl value of each of the resulting resins, and their average molecular weights (number average molecular weight) as measured by freezing point depression method.

Table 2

Reaction Conditions and Physical Properties of Resultant Resins

| I.D. symbol | Nonyl phenol (g) | Paraform-aldehyde (g) | 2N HCL (ml) | n-Butanol (ml) | Reaction Temp. (°C.) | Reaction Time (hr) | Average Molecular Weight | Hydroxyl Value |
|---|---|---|---|---|---|---|---|---|
| A | 111 | 16.5 | 5 | 100 | 85 | 3 | 474 | 233.2 |
| B | " | " | " | " | " | 3 | 719 | 238.5 |
| C | " | " | " | " | " | 8 | 986 | 234.2 |
| D | " | " | " | " | 100 | 3 | 1298 | 237.5 |
| E | " | 19.5 | " | " | " | 4 | 1617 | 236.4 |
| F | " | " | " | " | " | 5 | 2045 | 234.4 |
| G | — | — | — | — | — | — | 986 | 238.3 |

Note:
Resin G was provided with an average molecular weight equal to Resin C by mixing Resin B with Resin D having a molecular weight of 719 and 1298, respectively.

In addition, the introduction of a sulfonic acid into the polymer can be performed according to the methods described in, for example, Kogyo Kagaku Zasshi (J. of Industrial Chemistry), Vol. 73, page 563 (1956), etc.

In more detail, this reference discloses the following:

Reaction between 4-nuclei substance and propane sultone (synthesis of 4PSNa).

The following reported reaction scheme (See M. Koebner, *Angew. Chem.*, Vol. 46, page 251 (1933) was followed to synthesize a 4-nuclei substance (1).

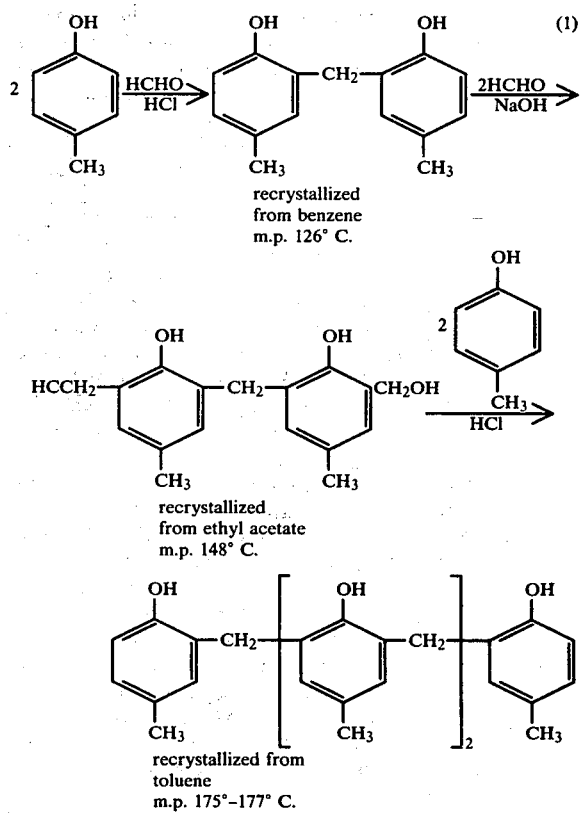

The synthesized 4-nuclei substance (1) was reacted with propane sultone as follows. A sample of 1 g (2.1 mmmol) of (1) was dissolved in an alkali aqueous solution comprising 0.36 g (9 mmol) of sodium hydroxide in 6 ml of water, and heated to 97° C. While sodium hydroxide (solid) was added portionwise to keep the pH of the solution at about 11, 2.2 g (18 mmol) of propane sultone was added dropwise over a period of 21 hours. Stirring continued at 97° C. at a controlled pH of 11.

The reaction was finished 40 hours later. During the reaction period, a total of 0.36 g of sodium hydroxide was added to the reaction system. Water was used to make a 2-fold dilution of the reaction mixture which was then rendered acidic with hydrochloric acid, the unreacted 4-nuclei substance was extracted with ether, and sulfonic acid salted out with sodium acetate. The product was dried, and the sodium acetate was extracted with anhydrous ethanol using a Soxhlet extractor for 24 hours, followed by recrystallization twice from a 1:1 mixture of ethanol and water, which produced 0.72 g of the end compound as the Na salt (yield 32.3%).

A conventional method was used to convert the Na salt into Ba salt and, then the Ba salt was carefully washed with water, dried over phosphorous pentoxide under vacuum.

Analysis: Calculated for $C_{43}H_{52}S_4O_{16}Ba_2$: S 10.45%, Ba 22.37%. Found: S 10.41% Ba 22.33%.

Reaction between 5-nuclei substance and propane sultone (synthesis of 5 PSNa)

The following reported reaction scheme, (see: H. Kaemmerer, W. Rausch, *Makro, Chem.*, 18–19, 9 (1955); H. Kaemmerer, H. Schweikert, *Makro, Chem.*, 56, 123 (1962); and P.P.T. Sah, H. H. Anderson, *J. Amer. Chem. Soc.*, 63, 3165 (1941))

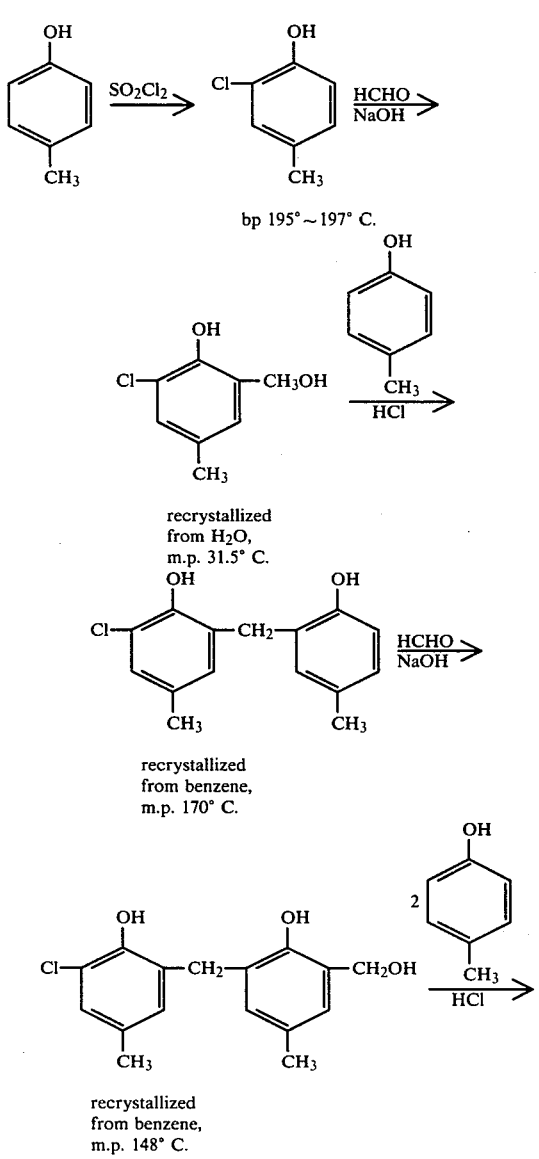

3
(2)

-continued

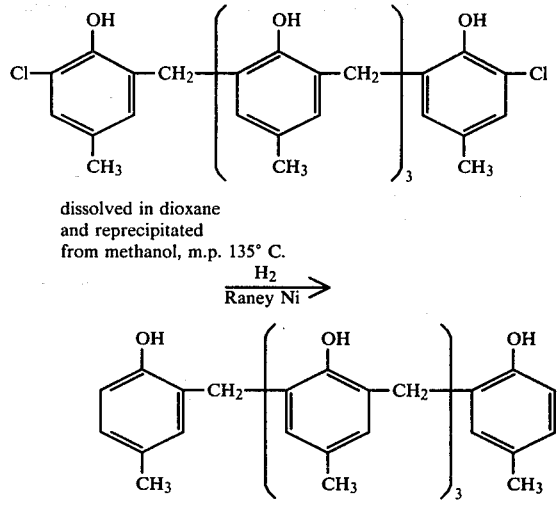

The synthesized 5-nuclei substance (2) was reacted with propane sultone as follows. A sample of 1 g (1.7 mmol) of (2) was dissolved in an alkali aqueous solution prepared by dissolving 0.36 g (9 mmol) of sodium hydroxide in 6 ml of water, and heated to 97° C. The subsequent reaction and purification were performed under the same conditions as used in the 4-nuclei substance above, which produced 1.2 g of the end product as the Na salt (yield 45%). The product was converted to barium salt in the same manner as in the 4-nuclei substance above.

Analysis: Calculated for $C_{54}H_{65}S_5O_{20}Ba_{2.5}$: Ba 22.33% S 10.43% Found: Ba 22.26%, S 10.39%

The surface active polymer employed in the present invention can be incorporated, within the range permitted by solubility, either into a solution of an oil-soluble photographic additive or into an aqueous colloid solution (or into an aqueous solution which does not contain a hydrophilic colloid), or into both solutions. When an oil-soluble surface active polymer is used, the oil-soluble surface active polymer is dissolved in an organic solvent in an amount of about 0.3 g to about 3 g per 10 cc of the organic solvent. When a water-soluble surface polymer is used, the water-soluble surface active polymer is dissolved in water in an amount of about 0.1 g to about 5 g per 100 cc of water.

The surface active polymer employed in the present invention can be used not only individually but as combinations thereof and also in combinations with other surface active agents. A combined use with certain other surface active agents is sometimes preferred rather than the individual use of the surface active polymer used in this invention.

The surface active polymer employed in the present invention can be used in combination with anionic surface active agents and/or nonionic surface active agents.

Preferred anionic active agents which can be used with the surface active polymer used in this invention are anionic surface active agents containing a hydrophobic group having 8 to 30 carbon atoms and an —$SO_3M$ or —$OSO_3M$ group (wherein M has the same meaning as defined in the formula (I) above) in the same molecule. These types of anionic surface active agents are described in Ryohei Oda and Kazuhiro Teramura, *Kaimen Kasseizai no Gosei to Oyo* (*Synthesis and Applications of Surface Active Agents*), Maki Shoten, Tokyo (1967), and A. M. Schwartz et al., *Surface Active Agents*, Interscience Publications Inc., New York (1956).

Preferred nonionic surface active agents are nonionic surface active agents and polyvalent alcohol fatty acid type surface active agents as described in Japanese Patent Application (OPI) 30933/73. (The term "OPI" as used herein refers to a "published unexamined Japanese patent application ".) Preferred polyvalent alcohol fatty acid ester type surface active agents are those having at least two hydroxy groups, preferably at least three hydroxy groups, and acyl having 6 to 25 carbon atoms in the fatty acid. Specifically, nonionic surface active agents of the sorbitan fatty acid ester type as described in U.S. Pat. No. 3,676,141 can be advantageously employed in the present invention. A suitable weight ratio of the surface active polymer used in this invention to the anionic surface active agent and/or the nonionic surface active agent ranges from about 0.1:1 to about 10:1, preferably 0.5:1 to 3.0:1.

Specific examples of suitable anionic surface active agents as described above include the following compounds:

$C_{12}H_{25}OSO_3Na$ (A-1)
$C_{14}H_{29}OSO_3Na$ (A-2)
Turkey red oil (A-3)
$C_{12}H_{25}CONHCH_2CH_2OSO_3Na$ (A-4)
$C_{12}H_{25}SO_3Na$ (A-5)
$C_{14}H_{29}SO_3Na$ (A-6)

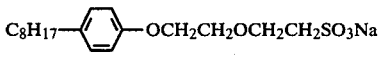
(A-7)

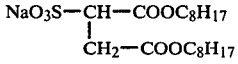
(A-8)

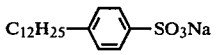
(A-9)

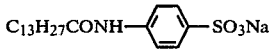
(A-10)

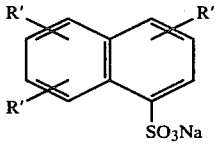
(A-11)

wherein R' represents $-CH(CH_3)_2$

Anionic surface active agents (A-8), (A-9) and (A-11) are particularly preferred.

In the present invention, it is particularly preferred for (a) at least one kind of surface active polymer employed in the present invention, (b) at least one kind of anionic surface active agent containing a hydrophobic group having 8 to 30 carbon atoms and an $-SO_3M$ or $-OSO_3M$ group (wherein M has the same meaning as defined in the formula (I) above), in combination, in the same molecule thereof, and/or (c) at least one kind of sorbitan fatty acid ester type nonionic surface active agents, to be used in combination.

In the present invention, the term "oil-soluble photographic additive" refers to an additive which is soluble in water at room temperature (about 20° C.) to an extent not greater than about 3 wt%.

Examples of oil-soluble photographic additives to which the present invention is applicable include, for example, oil-soluble couplers, DIR colorless coupling compounds, ultraviolet absorbants, dye image stabilizers, antioxidants, dye releasing agents for the color diffusion transfer method, dye developers and the like.

Representative examples of oil-soluble couplers to which the present invention is applicable are described, for example, below.

Open chain diketomethylene type compounds are generally widely employed as yellow couplers and suitable examples are described in U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194, German Patent Applications (OLS) Nos. 2,057,941, 2,213,461, 2,219,917, 2,261,361 and 2,263,875, etc. 5-Pyrazolone type compounds are mainly employed as magenta couplers but indazolone type compounds and cyanoacetyl compounds are also used. Examples of suitable magenta couplers are described in, for example, U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Applications (OPI) Nos. 111631/74 and 13041/75, German Pat. No. 1,810,464, Japanese Patent Publication No. 2016/69, Japanese Patent Application (OPI) No. 131448/74, U.S. Pat. No. 2,983,608, etc.

Phenol or naphthol derivatives are mainly employed as cyan couplers. Typical examples of suitable cyan couplers are described in, for example, U.S. Pat. Nos. 2,369,929, 2,474,293, 2,698,794, 2,895,826, 3,311,476, 3,458,315, 3,560,212, 3,582,322, 3,591,383, 2,434,272, 2,706,684, 3,034,892 and 3,583,971, German Patent Application (OLS) No. 2,163,811, Japanese Patent Publication No. 28836/70, Japanese Patent Application (OPI) No. 122335/74, etc.

Suitable colored couplers which can be used are those described in, for example, U.S. Pat. Nos. 3,476,560, 2,521,908 and 3,034,892, Japanese Patent Publication Nos. 2016/69, 22335/63, 11304/67 and 32461/69, Japanese Patent Application Nos. 98469/74 now opened to public inspection as Japanese Patent Application (OPI) No. 26034/76 and 118029/75 now opened to public inspection as Japanese Patent Application (OPI) No. 42121/77, German Patent Application (OLS) No. 2,418,959, etc.

Suitable development inhibitor releasing couplers (DIR couplers) upon color formation which can be employed are those as described in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application No. 146570/75 now opened to public inspection as Japanese Patent Application (OPI) No. 69624/77.

The oil-soluble couplers to which the present invention is applicable include the above-described yellow couplers, magenta couplers, cyan couplers, colored couplers and DIR couplers.

The method of dispersion of the present invention is also applicable to DIR colorless coupling compounds, e.g., as described in U.S. Pat. Nos. 3,297,445 and 3,379,529, German Patent Application (OLS) No. 2,417,914.

The couplers described above can be emulsion dispersed at the same time in order to incorporate two or more kinds in one layer for the purpose of achieving the properties which are required in light-sensitive materials. Some specific examples of coupler compounds are shown below.

Yellow Dye Forming Couplers (Y-1)

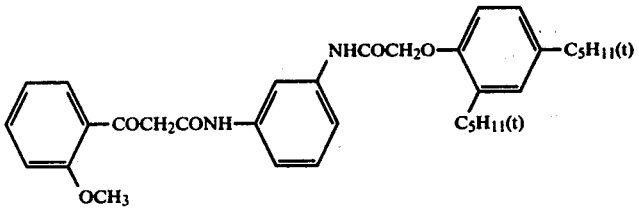

(Y-2)

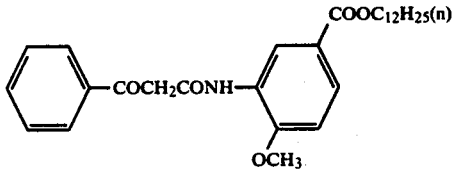

(Y-3)

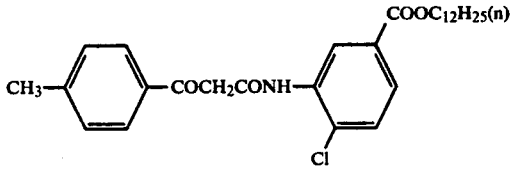

(Y-4)

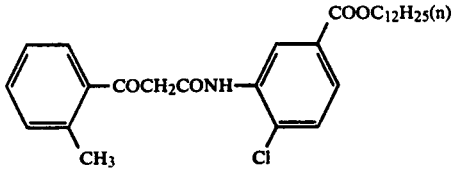

(Y-5)

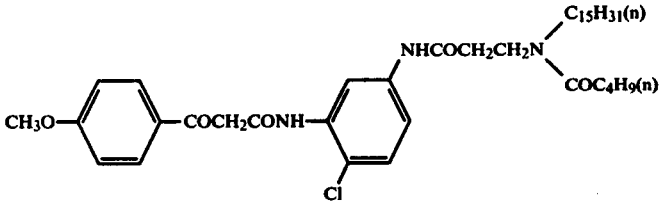

(Y-6)

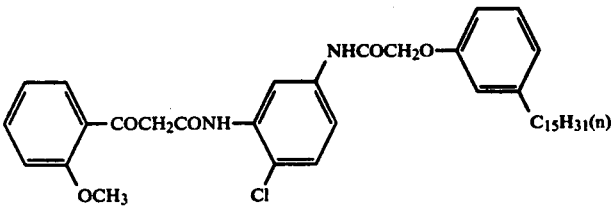

Magenta Dye Forming Couplers (M-1)

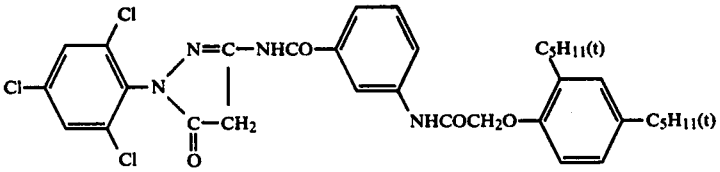

(M-2)

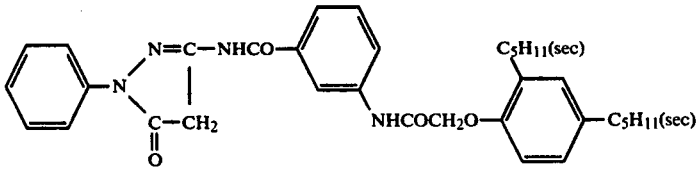

-continued
(M-3)
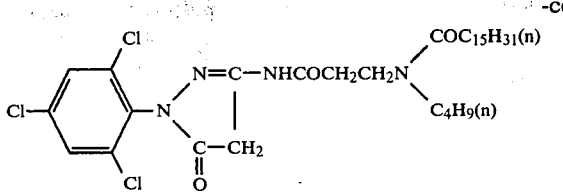
(M-4)
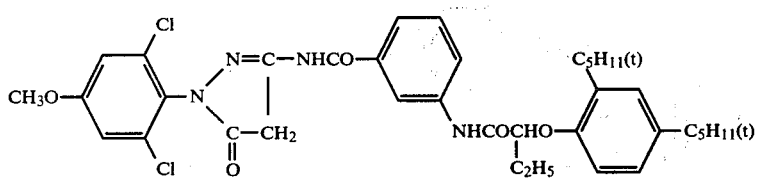
(M-5)
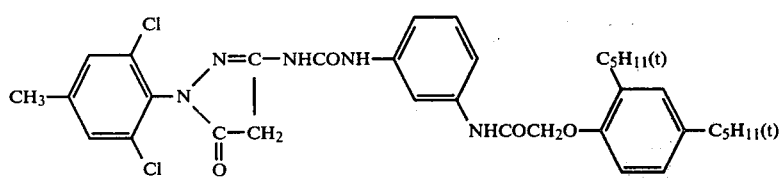
Cyan Dye Forming Couplers
(C-1)
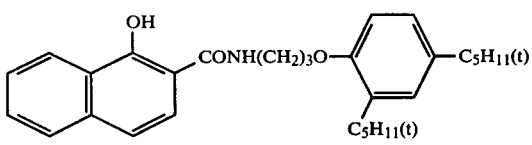
(C-2)
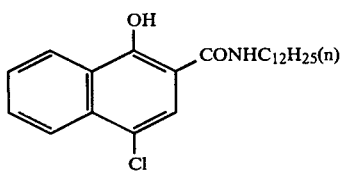
(C-3)
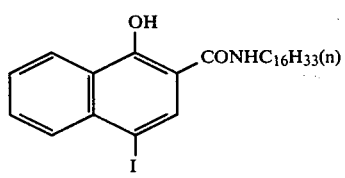
(C-4)
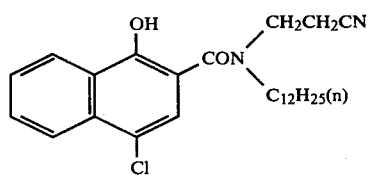
(C-5)
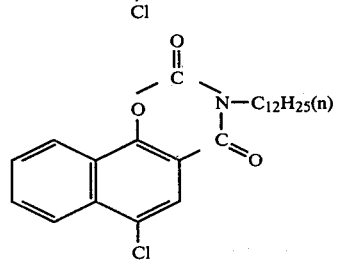
(C-6)
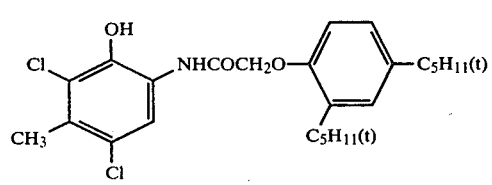
Colored Couplers for Masking -continued
(L-1)
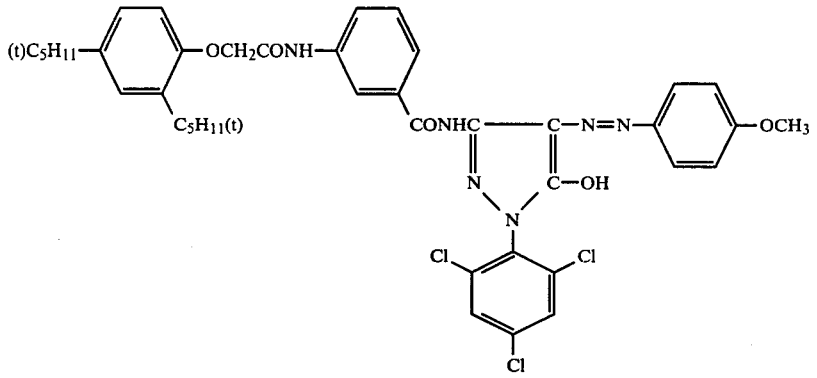
(L-2)
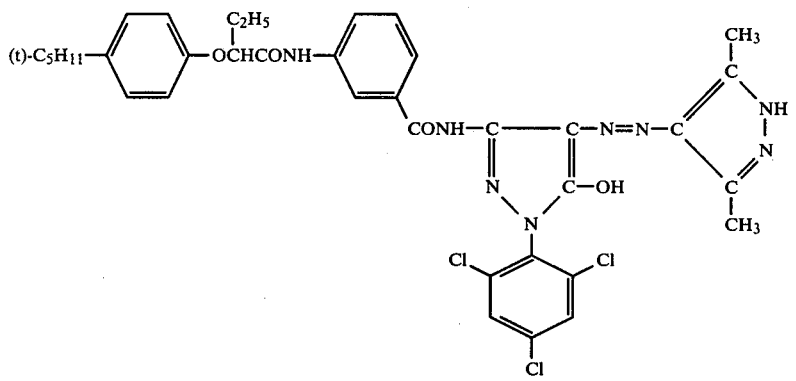
(L-3)
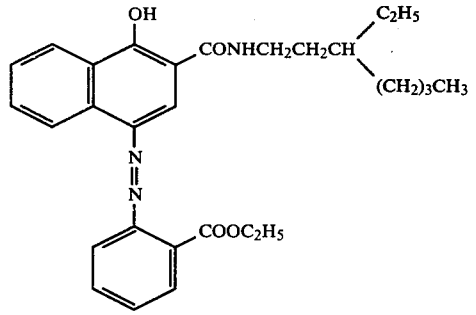
(L-4)
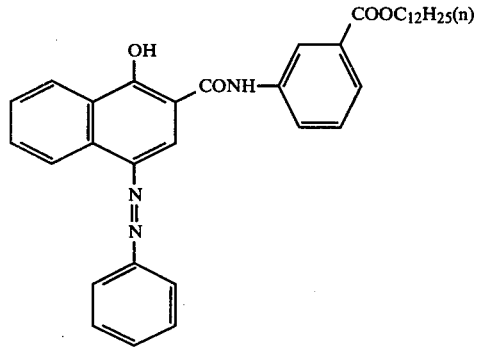
Development Inhibitor Releasing (DIR) Couplers
(N-1)
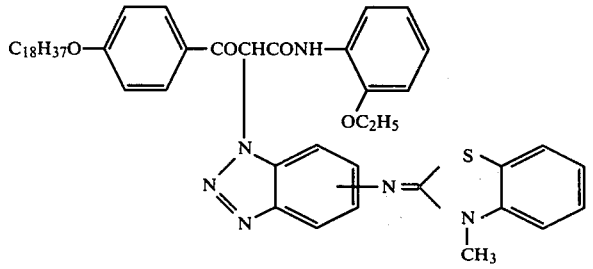

-continued (N-2)

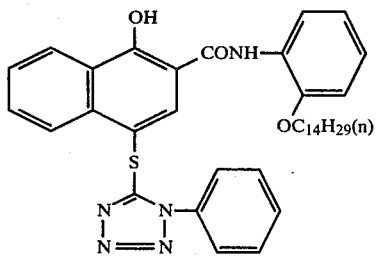

(N-3)

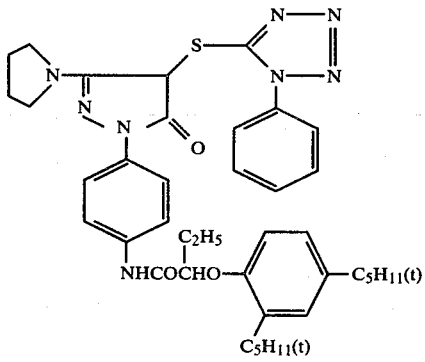

Oil-soluble ultraviolet light absorbants which are suitable for the practice of the present invention are described in, for example, Japanese Patent Publication Nos. 21687/67 and 6/73, Japanese Patent Application (OPI) No. 1026/72, British Pat. No. 1,293,982, etc.

Some specific examples of oil-soluble ultraviolet light absorbants which are suitable for the practice of the present invention are illustrated below.

(U-1)

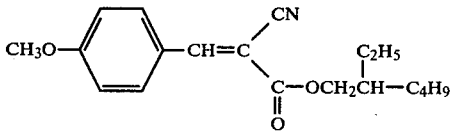

(U-2)

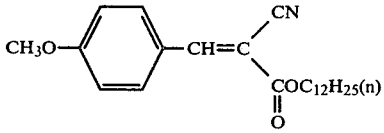

(U-3)

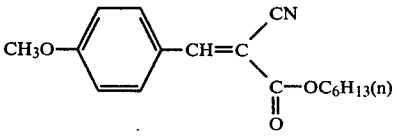

(U-4)

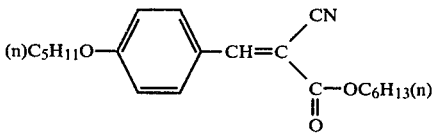

(U-5)

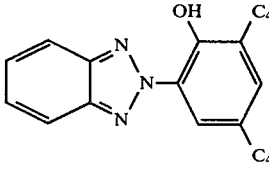

-continued (U-6)

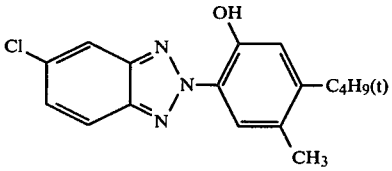

(U-7)

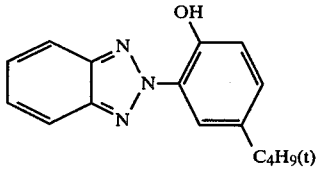

Some specific examples of oil-soluble antioxidants which are suitable for the practice of the present invention are illustrated below.

(AO-1)

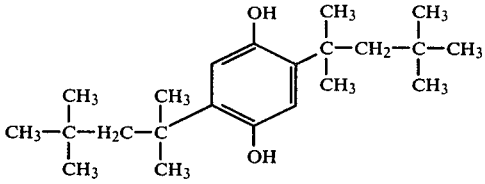

(AO-2)

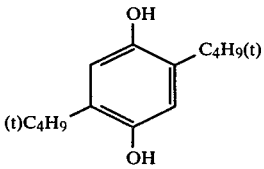

In addition, dye image stabilizers for colored dye images which are suitable for the practice of the present invention are described in, for example, Belgian Pat. No. 777,487, German Pat. No. 1,547,684, German Patent Application (OLS) No. 2,146,668, etc.

Examples of oil-soluble dye releasing compounds used in photographic elements for color diffusion transfer to which the present invention is applicable include, for example, dye releasing type redox compounds as described in Japanese Patent Applications (OPI) Nos. 33826/73, 11424/74, 126332/74, 115528/75, 126331/74, 109928/76 and 113624/76.
Specific examples thereof include the following compounds.
(DR-1)
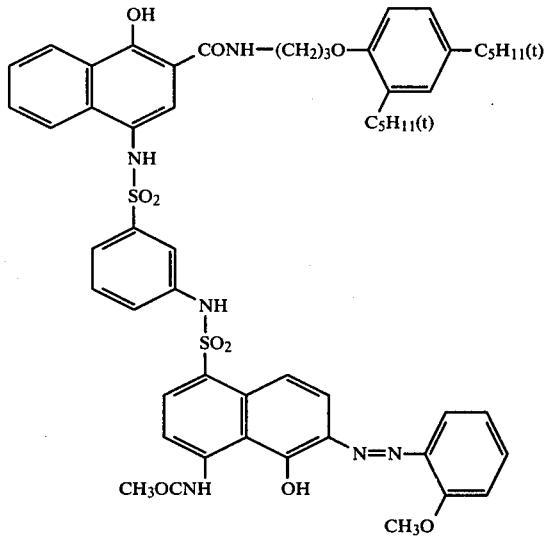
(DR-2)
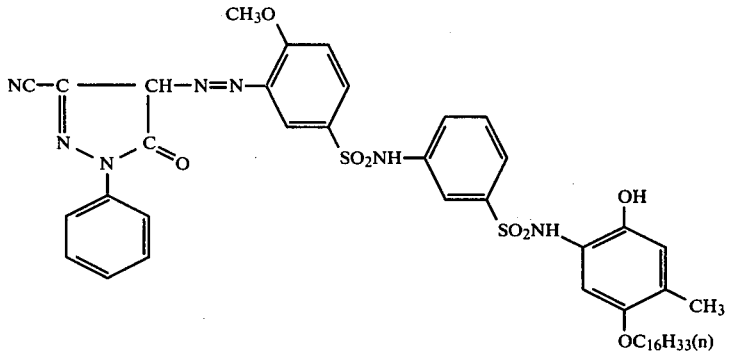
(DR-3)
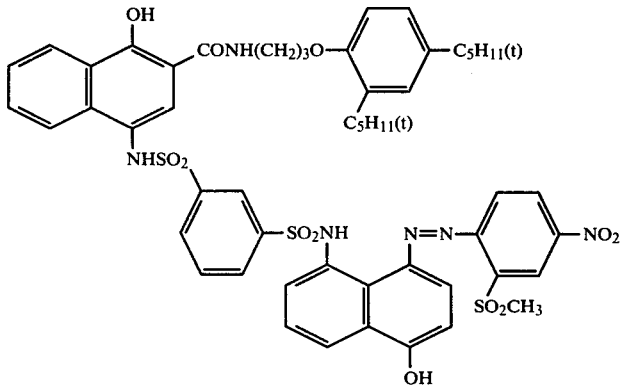

-continued (DR-4)

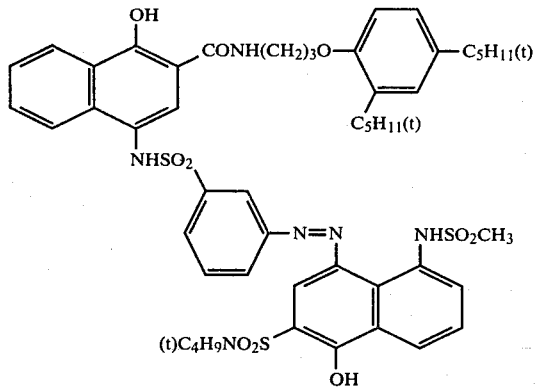

(DR-5)

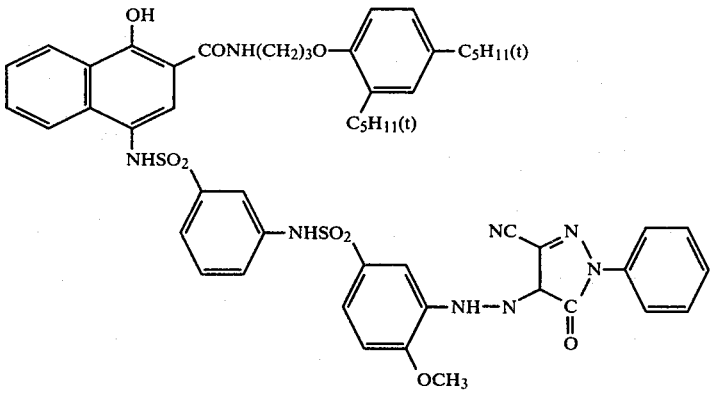

Further, compounds which release dyes upon coupling, as described in British Pat. Nos. 840,731, 904,364, 904,365 and 1,038,331, U.S. Pat. Nos. 3,227,551 and 3,327,554, etc.; compounds which form dyes upon coupling, as described in British Pat. Nos. 840,731 and 904,364, U.S. Pat. Nos. 3,227,551 and 3,227,554, etc.; dye developers as described in U.S. Pat. Nos. 3,415,644, 3,415,645, 3,415,646, 3,594,164 and 3,594,165, etc., can be employed in the present invention.

Some specific examples of dye developers which are suitable for the practice of the present invention are illustrated below.

(DD-1)

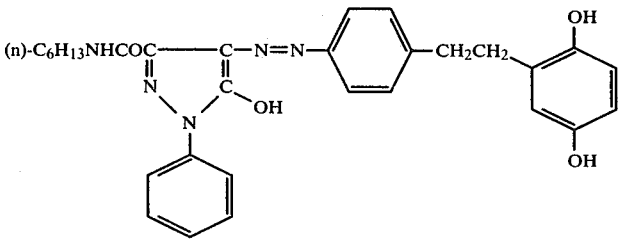

(DD-2)

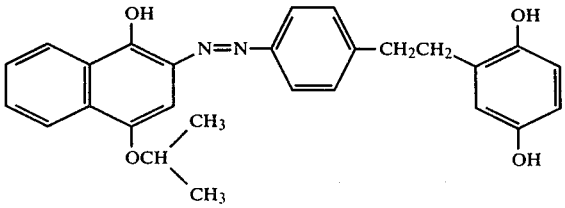

(DD-3)

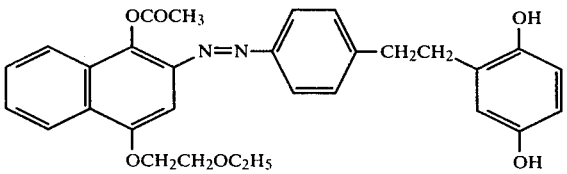

-continued (DD-4)

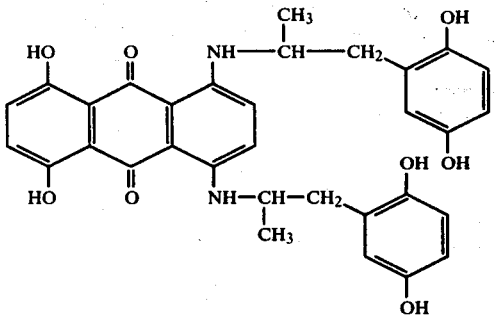

In the present invention, the oil-soluble photographic additive must be previously either melted by heating or dissolved in an organic solvent, prior to emulsifying, to liquify the additive. Photographic additives which can be directly emulsified by melting are limited to those having melting points of below about 90° C.

Suitable organic solvents (i.e., oil components) which can be employed for finely dispersing the oil-soluble photographic additive in an aqueous medium are those organic solvents which are substantially insoluble in water and have a boiling point of higher than about 190° C. under normal pressure. Suitable examples of these high boiling organic solvents include carboxylic acid esters, phosphoric acid esters, carboxylic acid amides, aromatic ethers and substituted hydrocarbons such as chlorinated paraffins. Specific examples of such organic solvents include di-n-butyl phthalate, diisooctyl phthalate, dimethoxyethyl phthalate, di-n-butyl adipate, diisooctylazelate, tri-n-butyl citrate, butyl laurate, di-n-sebacate, tricresyl phosphate, tri-n-butyl phosphate, triisooctyl phosphate, N,N-diethylcaprylic amide, N,N-dimethylpalmitic amide, n-butyl m-pentadecylphenyl ether, ethyl 2,4-tert-butylphenyl ether, chlorinated paraffin, etc.

In the present invention, it is advantageous at times to use, in addition to the high boiling solvents described above, low boiling point organic solvents (having a boiling point of less than about 130° C. under normal pressure) or water-soluble high boiling point solvents in combination, in order to dissolve the oil-soluble photographic additive. Examples of these solvents include propylene carbonate, ethyl acetate, butyl acetate, ethyl propionate, sec-butyl alcohol, tetrahydrofuran, cyclohexanone, dimethylformamide, diethyl sulfoxide, methyl Cellosolve, etc.

Emulsifying means which can be suitably employed in the practice of the present invention are those imparting a large shearing force to a liquid to be treated or imparting a very strong ultrasonic wave energy thereto. In particular, a colloid mill, a homogenizer, a capillary tube type emulsifying apparatus, a liquid syren, an electric magnetostriction type ultrasonic wave inducing machine, a Polytron (made by KINEMATICA GmbH), and an emulsifying apparatus equipped with a Pohlman pipe can give good results.

The amount of the surface active polymer which is used in the present invention can be varied depending upon the kind of oil-soluble photographic additive(s) employed (for example, couplers, ultraviolet light absorbants, antioxidants, dye releasing compounds for color diffusion transfer, etc.), the kind as well as amount of organic solvents used for dispersion, and optionally, the kind and amount of other surface active agents used in combination therewith, and the kind of color light-sensitive material to be produced, but, generally, about 0.5 to about 50 wt%, preferably about 0.5 to about 10 wt%, based on the weight of the dipersion (that is, the dispersion in which the oil-soluble photographic additive is dispersed in a dispersion solvent). The particle size generally achieved using the method of this invention is about 1 μm or less.

In the present invention, the oil-soluble photographic additive can be dispersed either in water or in a hydrophilic colloid composition, but it is preferred in the practice of the present invention for the oil component to be dispersed in a hydrophilic colloid composition.

Suitable hydrophilic colloids which can be employed in the hydrophilic colloid composition which is employed in the present invention are the binders generally used in silver halide photographic light-sensitive materials or a protective colloid.

It is advantageous to use gelatin as the binder or protective colloid for photographic emulsions, but other hydrophilic colloids can also be employed. For example, gelatin derivatives, graft polymers of gelatin and other high molecular weight materials, proteins such as albumin, casein, etc.; cellulose derivatives such as hydroxyethyl cellulose, carboxymethyl cellulose, cellulose sulfate, etc.; sodium alginate, saccharide derivatives such as starch derivatives, etc.; a variety of synthetic hydrophilic high molecular weight materials such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be employed.

Not only lime-treated gelatin but also acid-treated gelatin can be used as the gelatin. In addition, gelatin hydrolysates or gelatin decomposed with an enzyme can also be employed. Gelatin derivatives which can be used are those obtained by reacting gelatin with a variety of compounds, for example, acid halides, acid anhydrides, isocyanates, bromoacetic acid, alkane sultones, vinylsulfonamides, maleimide compounds, polyalkylene oxides, epoxy compounds, etc. Specific examples of these compounds are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

Examples of the above-described gelatin graft polymers which can be employed include those obtained by grafting gelatin with a homopolymer or copolymer of vinyl monomers such as acrylic acid, methacrylic acid or derivatives thereof such as the esters or amides thereof, acrylonitrile, styrene, etc. In particular, graft polymers with polymers which are relatively compatible with gelatin, such as polymers of acrylic acid, methacrylic acid, acrylamide, methacrylamide, hydroxyalkyl methacrylates, etc., are preferred. Examples of these are described in U.S. Pat. Nos. 2,763,625, 2,831,767 and 2,956,884, etc.

Representative synthetic hydrophilic high molecular weight materials are, for example, described in German Patent Application (OLS) No. 2,312,708, U.S. Pat. Nos. 3,620,751 and 3,879,205 and Japanese Patent Publication No. 7561/68.

Some of the effects and advantages which are achieved by the present invention are described below.

By the practice of the present invention, photographic additives such as oleophilic couplers, oleophilic ultraviolet light absorbants, oleophilic antioxidants and dye releasing compounds, etc., can be finely emulsion dispersed and in a stable manner without damaging the photographic properties (particularly without aggregation and crystallization of the particles with the passage of time occurring), and no problem is cncountered in the coating operation, and improved photographic light-sensitive materials in which crystallization in the surface layer after coating of the dispersion and drying does not occur can thus be obtained.

Conventional emulsifiers which are used for photography are generally hygroscopic and have a tendency to degrade the quality of the surface layer of the light-sensitive material. Therefore, if the amount of the emulsifier employed becomes large, the surface tends to be adhesive. However, the surface active polymer which is employed in the present invention is less hygroscopic so that adhesion difficulties of the surface layer are also minimized.

In the photographic light-sensitive material produced by the present invention, all conventionally used supports for photographic light-sensitive materials can be used. For example, suitable supports include a cellulose nitrate film, a cellulose acetate film, a cellulose acetate butyrate film, a cellulose acetate propionate film, a polystyrene film, a polyethylene terephthalate film, a polycarbonate film, laminates thereof, paper, etc. Supports such as baryta paper, paper having coated or laminated thereon an $\alpha$-olefin polymer, especially an $\alpha$-olefin having 2 to 10 carbon atoms such as polyethylene, polypropylene, etc.; a synthetic resin film whose surface has been coarsened to thereby improve adhesion with other high molecular weight materials, as described in Japanese Patent Publication No. 19068/72, etc., can also be suitably used.

A variety of hydrophilic colloids can be employed for the photographic light-sensitive material produced by the present invention. As hydrophilic colloids which are used as binders for photographic emulsion and/or other photographic structures, the binders or protective colloids described herein-above can be employed.

The photographic emulsion layers and other layers which are employed in the photographic material produced in the present invention can contain synthetic polymer compounds, such as latex-type water dispersed vinyl compound polymers, especially compounds improving the dimensional stability of the photographic materials, individually or in combination with different kinds of polymers, or in combination thereof with hydrophilic water-permissible colloids. A variety of such polymers can be used and are described in, for example, U.S. Pat. Nos. 2,376,005, 2,739,137, 2,853,457, 3,488,708, 3,525,620, 3,635,715, 3,607,290 and 3,645,740, British Patent Nos. 1,186,699 and 1,307,373, etc. Of these, copolymers and homopolymers such as alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxy methacrylates, styrene, butadiene, vinyl chloride, vinylidene chloride, maleic anhydride, and itaconic anhydride are generally employed. Where these vinyl compounds are emulsion polymerized, a so-called graft emulsion polymerization latex performed in the presence of hydrophilic protective colloid high molecular weight materials can also be employed, as necessary.

Hardening of the photographic emulsion and/or other photographic layers can be carried out using conventional methods. Typical examples of hardening agents which can be used include aldehyde type compounds such as formaldehyde, glutaraldehyde; ketone compounds such as diacetyl, cyclopentanedione; compounds having a reactive halogen such as bis(2-chloroethylurea), 2-hydroxy-4,6-dichloro-1,3,5-triazine, or compounds as described in U.S. Patent Nos. 3,288,775 and 2,732,303, British Pat. Nos. 974,723 and 1,167,207, etc.; reactive olefin compounds such as divinylsulfone, 5-acetyl-1,3-diacryloylhexahydro-1,3,5-triazine, and compounds as described in U.S. Pat. Nos. 3,635,718, 3,232,763, 3,490,911 and 3,642,486, British Pat. No. 994,869, etc.; N-hydroxymethylphthalimide and N-methylol compounds as described in U.S. Pat. Nos. 2,732,316 and 2,586,168, etc.; isocyanates as described in U.S. Pat. No. 3,103,437, etc.; aziridine compounds as described in U.S. Pat. Nos. 3,017,280 and 2,983,611, etc.; acid derivatives as described in U.S. Pat. Nos. 2,725,294 and 2,725,295, etc.; carbodiimide type compounds as described in U.S. Pat. No. 3,100,704, etc.; epoxy compounds as described in U.S. Pat. No. 3,091,537, etc.; isoxazole type compounds as described in U.S. Pat. Nos. 3,321,313 and 3,543,292, etc.; halocarboxyaldehydes such as mucochloric acid, dioxane derivatives such as dihydroxydioxane, dichlorodioxane, etc.; chromium alum, zirconium sulfate, etc., as inorganic hardening agents. In addition, in lieu of the compounds described above, precursors thereof, for example, alkali metal bisulfitealdehyde adducts, methylol derivatives of hydantoin, primary aliphatic nitroalcohols, etc., can also be employed.

A silver halide photographic emulsion is ordinarily prepared by mixing a solution of a water-soluble silver salt (for example, silver nitrate) and a solution of a water-soluble halogen salt (for example, potassium bromide) in the presence of a solution of a water-soluble high molecular weight material such as gelatin. Suitable silver halides which can be used include silver chlorobromide, silver iodobromide, silver chloroiodobromide, etc., in addition to silver chloride and silver bromide. The silver halide grains can be prepared according to known conventional methods, e.g., using the single or double jet method, the control double jet method, etc. Two or more silver halide photographic emulsions which are independently prepared can be mixed, if desired.

The silver halide grains can be different between the interior portion and the surface layer or can be uniform grains. In addition, silver halide grains can be grains on the surface of which latent images are mainly formed, or grains in the inside of which latent images are mainly formed.

In order to prevent a decrease in sensitivity or the occurrence of fog during preparation of the light-sensitive materials, during storage or during processing, a variety of compounds can be incorporated into the photographic emulsions described above. A wide variety of compounds such as 4-hydroxy-6-methyl-1,3,3a,7-tetrazaindene, 3-methylbenzothiazole, 1-phenyl-5-mercaptotetrazole, and in addition thereto, heterocyclic compounds, mercury-containing compounds, mercapto compounds, metal salts, etc., can be used for this purpose. Suitable compounds which can be employed in the present invention are described in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,738,664, 2,728,665, 2,476,536, 2,824,001, 2,843,491, 2,886,437, 3,052,544, 3,137,577, 3,220,839, 3,226,231, 3,236,652, 3,251,691 3,252,799, 3,287,135, 3,326,681, 3,420,668, 3,619,198, 3,622,339 and 3,650,759, British Pat. Nos. 893,428, 403,789, 1,173,609 and 1,200,188, etc.

The silver halide emulsion can be chemically sensitized according to conventional methods. Typical examples of chemical sensitizers include gold compounds such as chloroaurates, auric trichloride, etc., as described in U.S. Pat. Nos. 2,399,083, 2,540,085, 2,597,856 and 2,597,915; salts of noble metals such as platinum, palladium, iridium, rhodium, ruthenium, etc., as described in U.S. Pat. Nos. 2,448,060, 2,540,086, 2,566,245, 2,566,263 and 2,598,079; sulfur compounds which react with silver salts to form silver sulfide, as described in U.S. Pat. Nos. 1,574,944, 2,410,689, 3,189,458 and 3,501,313, etc.; stannous salts, amines and other reducing materials as described in U.S. Pat. Nos. 2,487,850, 2,518,698, 2,521,926, 2,694,637, 2,983,610 and 3,201,254.

The photographic emulsions can be spectrally sensitized or supersensitized, if desired, by the individual use or the combined use of cyanine dyes such as cyanine, merocyanine, carbocyanine, etc., or by the combined use thereof with styryl dyes, etc. These color sensitization techniques are well known and are also described in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Patent Applications (OLS) Nos. 2,030,326 and 2,121,780, Japanese Patent Publication Nos. 4936/68, 14030/69 and 10773/68, U.S. Pat. Nos. 3,522,052, 3,527,641, 3,615,613, 3,615,632, 3,617,295, 3,635,721 and 3,694,214, British Pat. Nos. 1,137,580 and 1,216,203, etc. These sensitizers can be selected depending upon the purpose and utility of the light-sensitive materials such as the wavelength region to be sensitized, the sensitivity desired, etc.

The light-sensitive photographic material produced using the present invention can contain, as plasticizers, polyols as described in U.S. Pat. Nos. 2,960,404, 3,042,524, 3,520,694, 3,656,956 and 3,640,721, in the photographic layers.

The photographic light-sensitive material produced using the present invention can include, in addition to the silver halide emulsion layers, for example, a protective layer, a filter layer, an intermediate layer, an antihalation layer, a subbing layer, a backing layer, an antistatic layer, a curl balancing layer, as conventional non-light-sensitive photographic layers.

The photographic light-sensitive material produced using the present invention can contain, in the non-light-sensitive photographic layers, stilbene, triazine, oxazole and coumarin type compounds as whitening agents; various known filter dyes for photography as light absorbants; water-insoluble materials as described in British Pat. Nos. 1,320,564 and 1,320,565, U.S. Pat. No. 3,121,060; and surface active materials as described in U.S. Pat. No. 3,617,286; in addition, inorganic compounds such as silver halide, silica, strontium/barium sulfate, etc., with a suitable particle size, or polymer latexes such as polymethyl methacrylate, as matting agents.

The photographic light-sensitive material produced using the present invention can contain, in the photographic layers including the photographic emulsion layers, particularly, an antistatic layer which is provided as an outermost layer of the photographic light-sensitive material, as an antistatic agent, for example, hydrophilic polymers as described in U.S. Pat. Nos. 2,725,297, 2,972,535, 2,972,536, 2,972,537 2,972,538, 3,033,679, 3,072,484, 3,262,807, 3,525,621, 3,615,531, 3,630,743, 3,653,906, 3,655,384 and 3,655,386, British Pat. Nos. 1,222,154 and 1,235,075; hydrophobic polymers as described in U.S. Pat. Nos. 2,973,263 and 2,976,148; biguanide compounds as described in U.S. Pat. Nos. 2,584,362 and 2,591,590; sulfonic acid type anionic compounds as described in U.S. Pat. Nos. 2,639,234, 2,649,372, 3,201,251 and 3,457,076; phosphoric acid esters and quaternary ammonium salts as described in U.S. Pat. Nos. 3,317,344 and 3,514,291; cationic compounds as described in U.S. Pat. Nos. 2,882,157, 2,982,651, 3,399,995, 3,549,369 and 3,564,043; nonionic compounds as described in U.S. Pat. No. 3,625,695; amphoteric compounds as described in U.S. Pat. No. 3,736,268; complex compounds as described in U.S. Pat. No. 2,647,836; organic acid salts as described in U.S. Pat. Nos. 2,717,834 and 3,655,387, etc.

The present invention is applicable to the production of all kinds of photographic light-sensitive materials, whether black-and-white or color photographic materials.

The silver halide emulsion used can be photographic emulsions such as ortho emulsions, panchromatic emulsions, emulsions for recording infrared light, emulsions for X-rays or other invisible light recording, emulsions for color photography such as emulsions containing color forming couplers, emulsions containing dye developers, emulsions containing bleachable dyes, etc. In order to obtain dye images of color photographic light-sensitive materials, development processing subsequent to exposure is employed. The development processing basically includes color development, bleaching and fixing steps. These steps may be conducted separately or two or more steps may be conducted using a processing solution capable of conducting these functions. For example, a mono-bath blixing solution is an example of such a combination. In addition, each of these steps can be conducted as two or more steps, if necessary. Alternatively, a processing comprising a color development, a first fixing and bleach-fixing is also possible. In addition to the above steps, various additional steps such as a pre-hardening bath, a neutralization bath, a first development (black-and-white development), an image stabilizing bath, water washing and the like, can be included in the development processing. The preferred processing temperature is determined depending upon the light-sensitive materials and the processing solution formulations. Sometimes, the processing temperature is lower than about 18° C., but, in general, it is higher than about 18° C. in most cases. Particularly, a temperature of 20° and 60° C., more particularly between 30° and 60°

C. recently, can be used. The processing temperatures used for each of the steps of the processing do not need to be the same.

A color developing agent is a compound whose oxidation product reacts with a coupler to form a colored product, and is used in an alkaline aqueous solution having a pH of above 8, preferably 9 to 12. The color developing agent is a compound having a primary amino group on the aromatic ring thereof and is capable of developing exposed silver halide, or is a precursor which forms such a compound. Representative examples of preferred color developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-βmethoxyethylaniline, 4-amino-3-β-methanesulfonamidoethyl-N,N-diethylaniline, and the salts thereof (for example, the sulfates, hydrochlorides, sulfites, p-toluene sulfonates, etc., thereof). In addition, the compounds as described in U.S. Pat. Nos. 2,193,015 and 2,592,364, Japanese Patent Application (OPI) No. 64933/73, and L. F. A. Mason, *Photographic Processing Chemistry,* pages 226 to 229, Focal Press, London (1966) can be used. Further, the above-described compounds can also be used in combination with 3-pyrazolidones. As desired, a variety of additives can be added to the color developer. Typical examples of these additives include alkali agents (for example, hydroxides, carbonates, phosphates of alkali metals or ammonia); pH controlling or buffering agents (for example, weak acids, weak bases or the salts thereof, such as acetic acid or boric acid); development accelerators (for example, various pyridinium compounds or cationic compounds as described in U.S. Pat. Nos. 2,648,604 and 3,671,247; potassium nitrate or sodium nitrate; polyethylene glycol condensates or derivatives thereof as described in U.S. Pat. Nos. 2,533,990, 2,577,127 and 2,950,970, etc.; nonionic compounds such as polythio ethers of which the compounds described in British Pat. Nos. 1,020,033 and 1,020,032 are representative; polymer compounds having sulfite esters represented by the compounds described in U.S. Pat. No. 3,068,097; organic amines such as pyridine, ethanolamine, etc.; benzyl alcohol, hydrazines, etc.); antifogging agents (for example, alkali metal bromides, alkali metal iodides; nitrobenzimidazoles as described in U.S. Pat. Nos. 2,496,940 and 2,656,271; mercaptoimidazole, 5-methylbenzotriazole, 1-phenyl-5-mercaptotetrazole; compounds for rapid processing as described in U.S. Pat. Nos. 3,113,864, 3,342,596, 3,295,976, 3,615,522 and 3,597,199, etc.; thiosulfonyl compounds as described in British Pat. No. 972,211; phenazine-N-oxides as described in Japanese Patent Publication No. 41675/72, other antifogging agents as described in *Kagaku Shashin Binran,* Vol. II, pages 29 to 47 (1959), etc.); stain or sludge preventing agents as described in U.S. Pat. Nos. 3,161,513, 3,161,514, British Pat. Nos. 1,030,442, 1,144,481 and 1,251,558; inter layer effect-accelerators as described in U.S. Pat. No. 3,536,487, etc., preservatives (for example, sulfinic acid salts, acidic sulfinic acid salts, hydroxylamine hydrochloride, formsulfite, alkanolamine sulfite adducts, etc.).

The color light-sensitive materials used in this invention can be subjected to bleaching processing using conventional techniques, after color development. This processing can be performed separately from fixing or at the same time as the fixing.

If desired, a fixing agent can be added to this processing solution to form a bleach-fixing (blixing) bath. Many compounds can be employed as bleaching agents. In general, polyvalent metal compounds such as ferricyanate salts, bichromate salts, water-soluble cobalt (III) salts, water-soluble copper (II) salts, water-soluble quinones, nitrosophenol, iron (III), cobalt (III), copper (II); especially, complex salts of these polyvalent metal cations and organic acids, e.g., metal complex salts of aminopolycarboxylic acids such as ethylene-diamine tetraacetic acid, nitrilotriacetic acid, iminodiacetic acid, N-hydroxyethylethylene diaminetriacetic acid, malonic acid, tartaric acid, malic acid, diglycolic acid, dithioglycolic acid, etc., 2,6-dipicolinic acid copper complex salt, etc., peracids such as alkyl peracids, persulfates, permanganates, hydrogen peroxide, hypochlorites, chlorine, bromine, bleaching powders, etc., can be used, individually or in combination.

The processing solution can further contain bleaching accelerators as described in U.S. Pat. Nos. 3,042,520, 3,241,966, Japanese Patent Publication Nos. 8506/70 and 8836/70, and other various additives.

The following examples are given to illustrate the present invention in greater detail. Unless otherwise indicated, all parts, percents, ratios and the like are by weight.

EXAMPLE 1

A mixture of 10 g of Cyan Dye Forming Coupler (C-2) described hereinabove, 5 ml of di-n-butyl phthalate and 20 ml of ethyl acetate was heated at 65° C. to dissolve. The resulting solution was added to 100 ml of an aqueous solution containing 10 g of gelatin and 0.5 g of sodium dodecylbenzenesulfonate. The mixture was vigorously stirred with a homogenizer to obtain Emulsion Dispersion (A), which was made the control.

Emulsion Dispersion (B) was obtained in a manner similar to the above except that 1 g of Compound (1) used in the present invention was further incorporated in the mixture above.

The average particle size of oil droplets in these emulsion dispersions was determined using a light scattering method. The results obtained are shown in Table 1 below.

Table 1

| Emulsion Dispersion | Average Particle Size (μm) |
|---|---|
| (A) (control) | 0.15 |
| (B) | 0.10 |

As is clear from the results shown in Table 1 above, a finer dispersion could be obtained using compound (1) used in the present invention, as compared with the case in which no surface active polymer used in the present invention was employed.

EXAMPLE 2

A solution obtained by dissolving 10 g of Yellow Dye Forming Coupler (Y-4) described above in 5 ml of tricresyl phosphate and 20 ml of ethyl acetate with heating at 65° C. was added to 100 ml of an aqueous solution containing 0.5 g of sodium 4-(p-nonylphenoxy)butanesulfonate and 10g of gelatin. The mixture was passed through a colloid mill five times to obtain Emulsion Dispersion (C), which was made the control.

Emulsion Dispersion (D) was obtained in a manner similar to the above except that 0.5 g of Compound (3) used in the present invention was employed in lieu of sodium 4-(p-nonylphenoxy)butanesulfonate in the above mixture.

After these emulsion dispersions were allowed to stand at 5° C. for 7 days, the solid substances formed were dissolved and warm water of the same amount was added thereto. After filtration, 1.8 g of residue remained in Emulsion Dispersions (C), but only 0.1 g remained in Emulsion Dispersion (D). That is, by the use of surface active polymer used in the present invention, the stability of emulsion dispersion could be improved.

EXAMPLE 3

A mixture of 1.5 g of Ultraviolet Light Absorbant (U-5) described hereinabove, 4.5 g of Ultraviolet Light Absorbant (U-7), 10 ml of di-n-butyl phthalate and 10 ml of ethyl acetate was heated at 65° C. to dissolve. The resulting solution was added to 50 ml of an aqueous solution containing 5 g of gelatin and 0.25 g of sodium dodecylbenzenesulfonate. The mixture was vigorously stirred mechanically with a homogenizer to obtain Emulsion Dispersion (E), which was made the control.

Emulsion Dispersion (F) was obtained in a manner similar to the above except that 0.5 g of Compound (4) of the present invention was further added to the mixture above.

After these emulsion dispersions were allowed to stand at 5° C. for 14 days, the solids formed were dissolved and the same amount of warm water was added thereto. After filtration, 1.1 g of the filtration residue remained in Emulsion Dispersion (E), but only 0.2 g remained in Emulsion Dispersion (F). That is, by the use of surface active polymer employed in the present invention, the stability of the emulsion dispersion could be improved.

EXAMPLE 4

A mixture of 4 g of oil-soluble Antioxidant (AO-1) described hereinabove, 4 ml of di-n-butyl phthalate, 4 ml of tricresyl phosphate and 16 ml of ethyl acetate was heated at 60° C. to dissolve. The resulting solution was added to 100 ml of an aqueous solution containing 10 g of gelatin and 0.5 g of sodium dodecylbenzenesulfonate. The mixture was vigorously stirred mechanically with a homogenizer to obtain Emulsion Dispersion (G), which was made the control.

Emulsion Dispersion (H) was obtained in a manner similar to the above except that 0.2 g of Compound (5) of the present invention was further added to the mixture above.

After these emulsion dispersions were allowed to stand at 5° C. for 14 days, the solids formed were dissolved. After filtration, 0.8 g of the filtration residue remained in Emulsion Dispersion (G) and 0.07 g remained in Emulsion Dispersion (H).

As is clear from these results, by the use of the surface active polymer employed in the present invention, the stability of the emulsion dispersion could be improved.

EXAMPLE 5

A mixture of 10 g of Magenta Color Releasing Redox Compound (DR-1) described hereinabove, 0.6 g of sodium bis(2-ethylhexyl)sulfosuccinate, 5 ml of N,N-diethyllauryl amide and 40 ml of cyclohexanone was heated to dissolve. The resulting solution was added to 100 ml of an aqueous solution containing 10 g of gelatin. The mixture was vigorously mechanically stirred with a homogenizer to obtain Emulsion Dispersion (I), which was made the control.

Emulsion Dispersion (J) was obtained in a manner similar to the above except that 0.6 g of Compound (11) used in the present invention was employed in lieu of the sodium bis(2-ethylhexyl)sulfosuccinate.

These emulsion dispersions were heated at 40° C. for 6 hours with stirring. After allowing the emulsion dispersions to stand at room temperature, filtration was carried out and the residue amount was compared. In Emulsion Dispersion (I), 0.5 g of residue remained and 0.06 g of residue remained in Emulsion Dispersion (J).

As is clear from these results, the stability of the emulsion dispersion could be improved by the use of the surface active polymer used in the present invention.

EXAMPLE 6

A mixture of 10 g of Magenta Color Developing Agent (DD-2) described hereinabove, 15 ml of N,N-diethyllaurylamide, 22 ml of cyclohexanone and 0.4 g of Span 20 (trade name for sorbitan monolaurate, produced by Atlas Powder Co.) was heated at 80° C. to dissolve. The resulting solution was added to 120 ml of an aqueous solution containing 12 g of gelatin and 0.6 g of sodium bis(2-ethylhexyl)sulfosuccinate. The mixture was passed through a colloid mill, after stirring, to obtain Emulsion Dispersion (K), which was made the control.

Emulsion Dispersion (L) was obtained in a manner similar to the above except that 1 g of Compound (11) of the present invention was further added to the mixture above.

These emulsions were coated onto a cellulose triacetate base having a gelatin subbing layer thereon, in a dry thickness of about 3μ and further thereon an aqueous gelatin solution having the following composition was coated in a dry thickness of 1μ. The coated samples were stored under conditions of a temperature of 50° C. and 80% RH to examine the day on which crystals of the dye developing agents appeared. The results obtained are shown in Table 2 below.

| Composition of Aqueous Gelatin Solution: | |
|---|---|
| 10% Aqueous Gelatin Solution | 40 g |
| Water | 160 ml |
| 5% Aqueous Polyoxyethylene Sorbitan Monolaurate Solution | 8 ml |
| 1% Aqueous Mucochloric Acid Solution | 1 ml |

Table 2

| Emulsion Dispersion | Day on which Crystals of Magenta Dye Developing Agent Appeared (50° C., 80% RH) |
|---|---|
| (K) (control) | less than 1 day |
| (L) | Longer than 10 days |

As can be seen from the results in Table 2 above, the stability of the emulsion dispersion could be improved by the use of the surface active polymer compound used in the present invention.

While the invention has been described in detail and with reference to specific embodiments thereof, it will be apparent to one skilled in the art that various changes and modifications can be made therein without departing from the spirit and scope thereof.

What is claimed is:

1. A method for dispersing at least one oil-soluble photographic additive in water or a hydrophilic colloid composition which comprises dissolving said photographic additive in at least one organic solvent and dispersing the resulting organic solvent solution of the photographic additive in water or in a hydrophilic colloid composition in the presence of a surface active polymer comprising (a) a homopolymer of units represented by the formula (I):

(I)

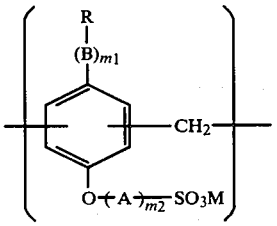

wherein R represents an aliphatic hydrocarbon group having 4 to 22 carbon atoms; $m_1$ and $m_2$ each represents 0 or 1; B represents —O— or —NH—; A represents a divalent aliphatic group having 1 to 50 carbon atoms; and M represents a hydrogen atom or a cation capable of forming a salt with a sulfonic acid group, or (b) a copolmyer containing at least 5 mol% of units represented by the formula (I) above and the balance of divalent units copolymerizable therewith and comprising at least one of a benzene ring having a methylene group attached thereto and a naphthalene ring having a methylene group attached thereto, wherein the surface active polymer is in the water, hydrophilic colloid or organic solvent.

2. The method for dispersing a photographic additive as claimed in claim 1, wherein said oil-soluble photographic additive is an oil-soluble coupler.

3. The method for dispersing a photographic additive as claimed in claim 1, wherein said oil-soluble photographic additive is an oil-soluble antioxidant.

4. The method for dispersing a photographic additive as claimed in claim 1, wherein said oil-soluble photographic additive is a dye releasing compound for the color diffusion transfer method.

5. The method for dispersing a photographic additive as claimed in claim 1, wherein said oil-soluble photographic additive is an oil-soluble ultraviolet light absorbant.

6. The method for dispersing a photographic additive as claimed in claim 1, wherein the surface active polymer has a molecular weight of about 600 to about 10,000.

7. The method for dispersing a photographic additive as claimed in claim 6, wherein the surface active polymer has a molecular weight of 900 to 5,000.

8. The method for dispersing a photographic additive as claimed in claim 1, wherein said surface active polymer is a surface active copolymer containing 5 to 95 mol% of units represented by the formula (I).

9. The method for dispersing a photographic additive as claimed in claim 1, wherein said unit copolymerizable therewith is at least one of

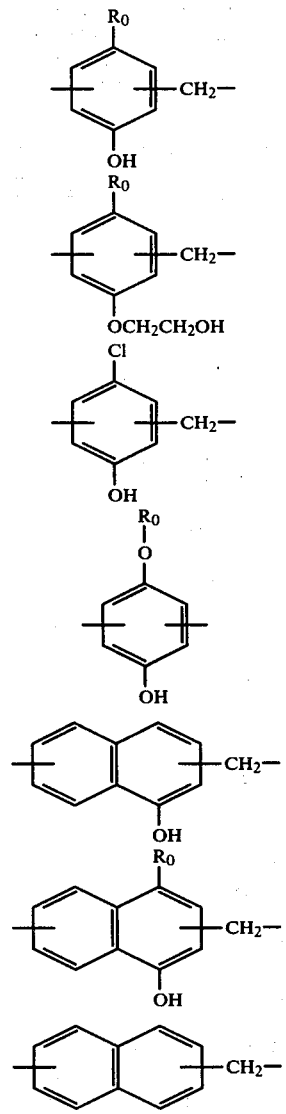

wherein $R_0$ represents an aliphatic hydrocarbon group having 2 to 22 carbon atoms.

* * * * *